US009247857B2

(12) United States Patent
Bari et al.

(10) Patent No.: US 9,247,857 B2
(45) Date of Patent: Feb. 2, 2016

(54) DISHWASHER AND A WATER TANK ADAPTED FOR A DISHWASHER

(75) Inventors: Elisabetta Bari, Stockholm (SE); Adam Szczepanowski, Stockholm (SE); Niklas Olson, Stockholm (SE); Sarah Förster, Stockholm (SE); Petter Svanbom, Hägersten (SE)

(73) Assignee: Electrolux Home Products Corporation, N.V., Brussels (BE)

( * ) Notice: Subject to any disclaimer, the term of this patent is extended or adjusted under 35 U.S.C. 154(b) by 940 days.

(21) Appl. No.: 13/128,378

(22) PCT Filed: Nov. 10, 2009

(86) PCT No.: PCT/EP2009/008011
§ 371 (c)(1),
(2), (4) Date: Jul. 27, 2011

(87) PCT Pub. No.: WO2010/052021
PCT Pub. Date: May 14, 2010

(65) Prior Publication Data

US 2011/0303253 A1 Dec. 15, 2011

(30) Foreign Application Priority Data

Nov. 10, 2008 (EP) ..... 08019585

(51) Int. Cl.
*A47L 15/00* (2006.01)
*A47L 15/42* (2006.01)

(52) U.S. Cl.
CPC ..... *A47L 15/0089* (2013.01); *A47L 15/4214* (2013.01); *A47L 15/4217* (2013.01); *A47L 15/421* (2013.01)

(58) Field of Classification Search
CPC ..... A47L 15/0089; A47L 15/0086; A47L 15/4445; A47L 15/4214; A47L 15/4217; A47L 15/421
USPC ..... 134/56 D
See application file for complete search history.

(56) References Cited

U.S. PATENT DOCUMENTS

| | | | | |
|---|---|---|---|---|
| 1,853,529 | A | 4/1932 | Zademach | |
| 1,859,302 | A * | 5/1932 | Lederman | 220/213 |
| 2,284,025 | A * | 5/1942 | Stockham | 134/25.2 |
| 2,771,893 | A | 11/1956 | Houghton | |
| 3,777,989 | A * | 12/1973 | Pacella et al. | 239/567 |

(Continued)

FOREIGN PATENT DOCUMENTS

| | | | |
|---|---|---|---|
| DE | 102006043917 | A1 * | 3/2008 |
| EP | 0 709 055 | A | 5/1996 |

(Continued)

OTHER PUBLICATIONS

Machine Translation of WO2006056514 (Jun. 1, 2006).*

(Continued)

*Primary Examiner* — Jason Ko
*Assistant Examiner* — Spencer Bell
(74) *Attorney, Agent, or Firm* — Alston & Bird LLP

(57) ABSTRACT

The invention relates to a dishwasher comprising a cabinet, a door for allowing access to a washing volume inside of the cabinet, and a water tank to be filled with water for washing. According to the invention, the water tank may be positioned within the washing volume inside the cabinet.

18 Claims, 5 Drawing Sheets

(56) References Cited

U.S. PATENT DOCUMENTS

| | | | | |
|---|---|---|---|---|
| 5,755,244 | A * | 5/1998 | Sargeant et al. | 134/46 |
| 6,571,421 | B1 * | 6/2003 | Sham et al. | 15/320 |
| 2010/0043852 | A1 * | 2/2010 | Classen et al. | 134/57 D |
| 2010/0065091 | A1 * | 3/2010 | Hartmann et al. | 134/104.2 |

FOREIGN PATENT DOCUMENTS

| | | | |
|---|---|---|---|
| EP | 0 820 718 | A2 | 1/1998 |
| FR | 2716793 | | 9/1995 |
| JP | 2005155998 | A * | 6/2005 |
| WO | WO 2004/023967 | A | 3/2004 |
| WO | WO 2006/056514 | A1 | 6/2006 |

OTHER PUBLICATIONS

Machine Translation of JP2005155998 (Jun. 16, 2005).*

Extended European Search Report for corresponding European Application No. 08019585.2 dated Apr. 24, 2009, 6 pages.

International Written Opinion for PCT/EP2009/008011 dated Feb. 5, 2010.

International Search Report from International Application No. PCT/EP2009/008011, filed Nov. 10, 2009.

* cited by examiner

DISHWASHER AND A WATER TANK ADAPTED FOR A DISHWASHER

CROSS REFERENCE TO RELATED APPLICATIONS

This application is a national stage application filed under 35 U.S.C. 371 of International Application No. PCT/EP2009/008011, filed Nov. 10, 2009, which claims priority from European Application No. 08019585.2, filed Nov. 10, 2008, each of which is incorporated herein in its entirety.

The present invention relates to a dishwasher comprising a cabinet, a door located in the cabinet for allowing access to the inside of the cabinet, and a water tank to be filled with water for washing.

The invention also relates to a water tank for a dishwasher.

BACKGROUND OF THE INVENTION

In today's society an increasing part of the population live on their own or in small families, often in rental apartments for a limited period of time. Many of them also eat few meals at home such that they generate small amounts of dishes on a daily basis. However, washing up is time consuming which often results in that the dirty dishes will be accumulated, such that their sink may nevertheless be filled up. Moreover, since they often live temporarily in small apartments, the solution to the above problem seldom is to acquire a regular dishwasher since the installation of it requires relatively lot of space, installation by a plumber as well as often permission from the landlord. Also, when it is time to move, the dishwasher will be a burden since regular dishwashers normally are quite bulky and it requires un-installation from the old apartment and reinstallation at the new apartment. On the market are known so called table-top dishwashers, which normally are somewhat less bulky than built-in dishwashers, but the rest of the disadvantages above remains essentially still.

Table-top dishwashers are usually placed on the kitchen bench top to be near the water supply and the drain. Above the bench top there are often wall mounted cupboards for plates, glasses and the like. It is therefore necessary for a table top dishwasher to fit into the space between the bench top and the cupboards and also to make it possible for the user to load and un-load the dishes to and from the dishwasher in a user friendly way.

Accordingly, there is a need for a small size dishwasher, which easily can be installed and uninstalled and which easily can be brought when moving from one place to another. WO 2006/056514 discloses a table-top dishwasher, which do not require any installation from a skilled worker, since it comprises a plug-in contact to be connected to a power outlet, a drain hose to be positioned with one end in a washing-up sink and a water reservoir to be filled manually before operation. However, the water reservoir is positioned on one side of the dishwasher and takes up a lot of space at the same time as it makes it more difficult to design the dishwasher to have a pleasant appearance, inter alia as the dishwasher will have an asymmetrical form due to the water reservoir. Moreover, the water reservoir constitutes a risk for water damage in case the water reservoir or its connection to the inside of the dishwasher should accidentally brake and begin to leak.

Table-top dishwashers like the above has a front opening for the dishes, the opening is closed by a door. The door is opened downward and when loading and unloading the dishwasher the dish rack is slided out from the dishwasher cabinet and rest on the inside of the door. This solution requires that there are space to fold down the door in front of the dishwasher and also usually that the dishwasher is secured to the bench top or is heavy enough so that the dishwasher will not fall if a full loaded disk rack is withdrawn from the cabinet and resting on the folded door. Both of which is a drawback when the dishwasher is to be moved.

SUMMARY OF THE INVENTION

It is an object of the invention to improve dishwashers, which do not require any installation in form of plumbing or the like. More precisely, it is an object to provide such a dishwasher by which the risk for water damage is reduced. At least this object is achieved by a dishwasher according to claim 1.

The invention also relates to a water tank for a dishwasher having essentially the same object as above. At least this object is achieved by a water tank according to claim 12.

Accordingly, the basis of the invention is the insight that the above object may be achieved by placing the water tank within the cabinet of the dishwasher. In this way also the conditions for designing the dishwasher with a pleasant appearance will be enhanced.

Within this overall idea, the invention may be formed in many different ways. The feature that the water tank is positioned within the cabinet means that the water tank may be positioned in a washing volume of the dishwasher, as in the hereinafter described and illustrated embodiment, i.e. in the same space as the dishes to be washed. However, it is to be understood that the water tank also can be positioned in a specially dedicated space inside the cabinet which e.g. can be separated from the washing volume by means of partition wall or the like. In a hereinafter described and illustrated embodiment, the water tank is made detachable from the dishwasher in order to facilitate filling it with water and eliminate the need for an additional vessel to be filled from a water tap and transferred to the water tank into which the water is filled. To facilitate handling of the detachable water tank, it is preferably provided with a gripping portion in form of a handle, grooves or the like. In the illustrated embodiment, the water tank is provided with a filler opening in an upper portion of the tank as well as a filler opening in a lateral surface of the water tank, in order to facilitate filling of water under a water tap or the like. It is to be understood however, that the water tank can be provided with only one filler hole if desired.

The water tank is connected to the dishwasher by means of a connection means in form of a quick coupling and normally it is preferred that the water from the tank can flow into the dishwasher by gravity. This requires a low positioned quick coupling and a stop valve, which will prevent outflow of water when filling at the water tap and which can be opened, automatically or manually, as soon as the tank is connected to the dishwasher. A detachable water tank would be even more hazardous if the water tank was positioned on the outside of the dishwasher since the risk for leakage will increase due to the detachable mounting. However, it is within the scope of the invention that the water tank also can be fixed positioned within the cabinet. In the illustrated embodiment, the water tank is positioned at one side of the dish rack, but it should be understood that it can be located also in other positions inside the cabinet and have other shapes than the essentially thin and circular shape as in the drawings.

Furthermore, the dishwasher can be provided with an ordinary door, for example a door which is essentially flat and opens by pivoting in a forward direction, in which case it is advantageous to arrange a dish rack so that to facilitate loading and unloading of dishes into and out of the dish rack. In the described and illustrated embodiments, the door is formed of one or two door portions, which each is formed with a part circular shape in cross section and are rotatably arranged in relation to a hinge joint at each side of the dishwasher. The hinge joints defines a common rotary axis for the door portions and the rotary axis also represents a common axis of curvature for the part circular door portions. Such an arrangement of the door portions allows them to be opened and closed by sliding in relation to each other and/or the cabinet of the dishwasher. In this way the door portions will open up a rather large opening, such that sufficient access is provided to the dish rack inside the dishwasher, in order to allow comfortable loading and unloading of dishes without any need for the dish rack to be extendible out from the cabinet. This also has to result that in the opened state, the dishwasher will not take up more space than when it is closed, which is advantageous in so far as it makes the dishwasher more suited to also be used as a drying rack for hand-washed dishes if desired. Such a slidable door can also be constituted by one single door portion or more than two door portions if desired.

One advantage with having a dish rack, which is not extendible from the cabinet, hereinafter referred to as a stationary dish rack, is that no anchoring is necessary of the dishwasher to a table-top or a wall in order to prevent tilting of the dishwasher forward when the dish rack is extended and heavy dishes are loaded in the dish rack. The term stationary should, in this context, be interpreted extensively and does not exclude that the dish rack can be detachable from the dishwasher, for cleaning and the like. However, it is within the scope of the invention that the dish rack can be fixed mounted in the dishwasher, e.g. be mounted by screws or moulded to the bottom of the dishwasher, but this would make cleaning of the dishwasher more difficult.

To allow washing of the dishes, the dishwasher is provided with some kind of spray nozzle system. For example, fixed spray nozzles mounted in the inside bottom of a body of the dishwasher, or nozzles arranged in one or more swivel arms being rotatably mounted inside the dishing compartment in a way known in the art.

At least one pump is provided in the dishwasher which is connected to the spray nozzle system for pumping water to the nozzles and allow spraying of the water towards the dishes. The same pump or a separate pump can also be arranged for discharging of water from the dishwasher through the drain hose after each completed washing cycle. However, in the described and illustrated embodiment, the discharging of water from the dishwasher is performed by means of gravity through a discharge opening, which is located on a low level in the bottom of the dishwasher. The discharge opening is closed and opened by an electrically operated drain valve. By leaving the drain valve open when the dishwasher is shut off, it is possible to use the dishwasher as a drying rack for hand washed dishes without accumulation of water inside the dishwasher or water and dried water stains on a kitchen sink, which normally is the case when using an ordinary drying rack.

Normally, there is provided a heater for heating the water in the dishwasher. However, it would be conceivable to provide a dishwasher, which does not comprise any heater. Instead warm water can be filled in the water tank by the user. Even in the case where a heater is provided, it could involve a saving of costs if a smaller size heater could be used or if the water tank is filled with warm water that is heated by means of energy which is less expensive than electricity.

A dishwasher according to the invention provides several advantages in relation to prior art dishwashers. In the preferred embodiment, it is intended that the cabinet can hold at least the same amount of water as can be accommodated inside the water tank. This is a precautionary measure in case the water from the water tank should leak out from the tank, in which case it will be captured inside the dishwasher and not flow out on for example the floor. It is preferred that the dishwasher is designed such that it consumes relatively small amounts of water during a washing cycle. In this way the water tank can be made with a small volume and be easy manageable for a person even when filled with water. In a preferred embodiment, the water tank may contain maximum 6 liters of water, preferably maximum 5 liters and most preferred maximum 4 liters of water. Moreover, a dishwasher according to the invention, is suitable for use in areas with no constant or unreliable water supply, since the user can fill up the tank when water is present, but can wait and do the dishes until the dishwasher is filled with dishes.

BRIEF DESCRIPTION OF THE DRAWINGS

An embodiment of the invention will hereinafter be described by reference to the accompanying drawings, in which.

DETAILED DESCRIPTION OF AN EMBODIMENT OF THE INVENTION

Figure 1:
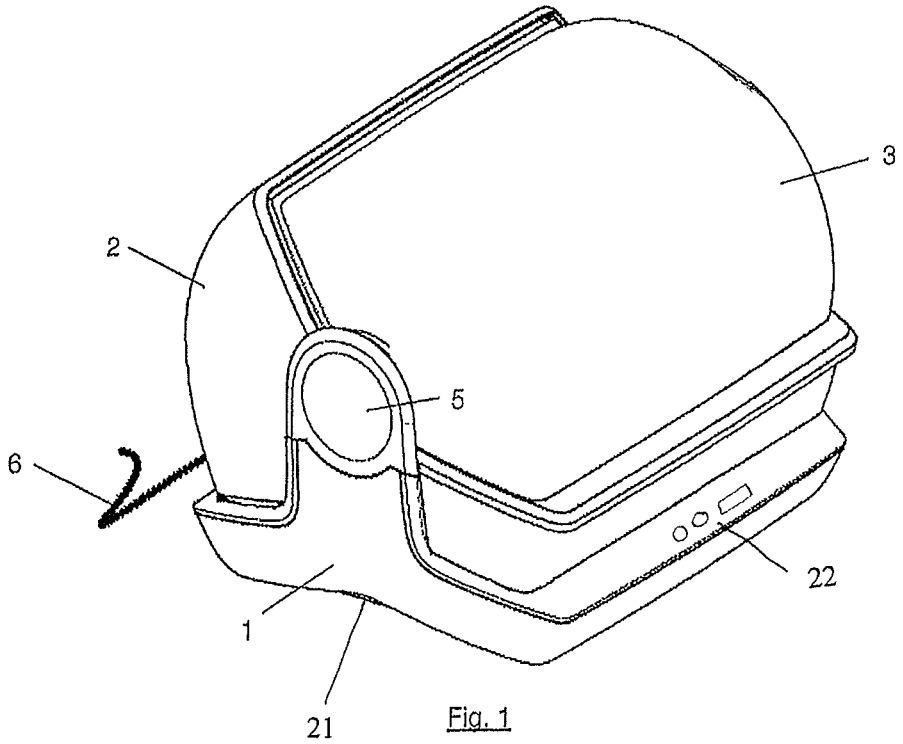
FIG. 1 is a perspective view of a dishwasher according to the invention with the door in a closed state.

Reference is first made to FIG. 1, in which is disclosed the outer appearance of a dishwasher according to the invention. The dishwasher comprises a cabinet in form of a body 1, which is adapted to be positioned on a bench top in a kitchen or the like, and which carries a rear cover portion 2 fixed mounted to the body. The dishwasher also comprises a door portion 3, which is formed with a part circular shape in cross section and is rotatably arranged in relation to a hinge joint 5 at each side of the dishwasher, e.g. a roll front door. The hinge joints 5 defines a rotary axis for door portion 3 and the rotary axis also represents a common axis of curvature for the part circular door portion. Such an arrangement of the door portion allows it to be opened and closed by sliding in relation to the cabinet of the dishwasher.

A drain hose 6 is in one end connected to a discharge opening of the body to allow discharge of water from the bottom of the dishwasher to a kitchen-sink, or the like, in which a free outer end of the drain hose can be positioned.

Figure 2:
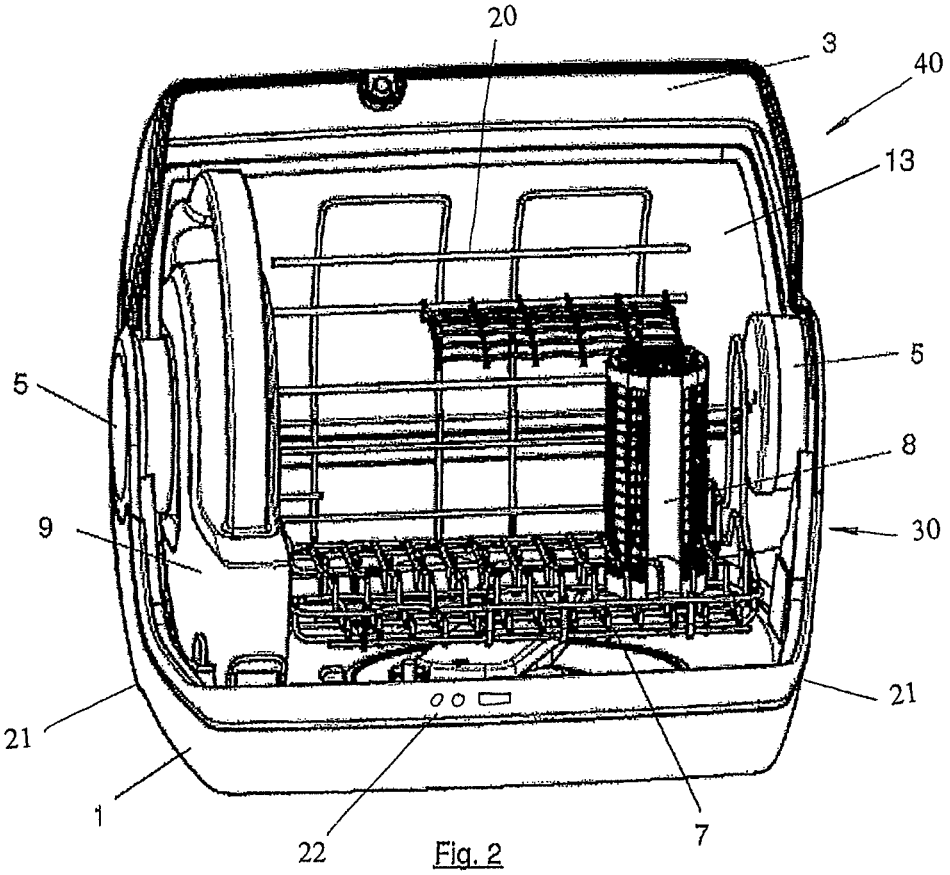
FIG. 2 is a perspective view of the dishwasher according to FIG. 1 in an open state.
Figure 3:
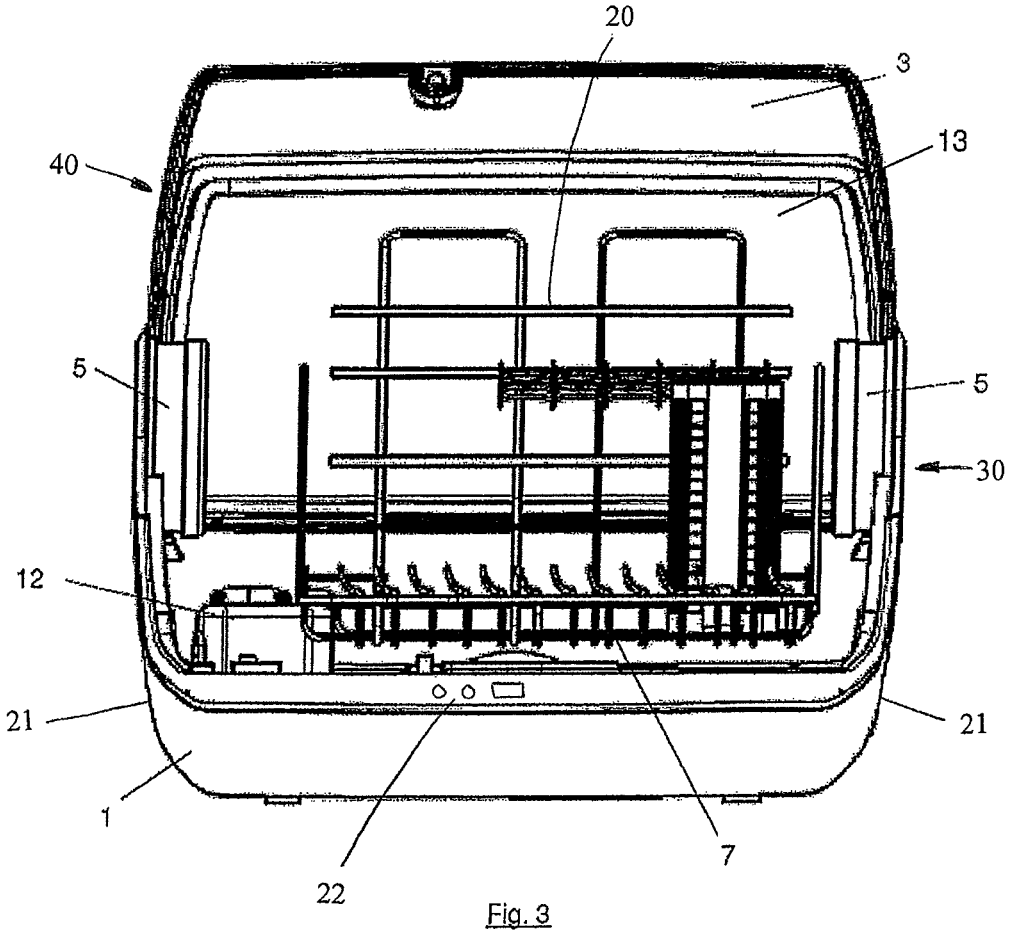
FIG. 3 is a front view of the dishwasher in the opened state with a water tank removed.

When the door portion is displaced to an opened state, a large access opening to the interior of the dishwasher is uncovered, as is illustrated in FIGS. 2 and 3, such that free access is allowed to the interior of the dishwasher from the front of the dishwasher. The opening comprises a main vertical front opening 30 and a smaller horizontal top opening 40. Inside, the dishwasher is provided with a stationary dish rack 7 for dish wares, like plates, glasses and the like, and a holder 8 for table cutlery and the like. The dish rack also comprises means 20 for preventing dishes from blocking the opening of the door. During the washing of the dishes it is possible that water pressure, vibrations or the like moves the dishes or even make them fall. If the dishes would move or fall towards the back wall of the cabinet it could block the opening of the door. The means for preventing this could be horizontal and vertical bars 20 extending essentially parallel to the back wall of the cabinet, and fixed or removably attached to the dish rack or the cabinet.

Inside the dishwasher is also a water tank 9, which is positioned within the cabinet 1, 2 at one side of the dishwasher in a space adjacent the dish rack 7. Accordingly, in the illustrated embodiment, the water tank is positioned within a washing volume 13 of the dishwasher, i.e. within the same space as the dishes to be washed. However, it is to be understood that the water tank also can be positioned inside a specially dedicated space within the cabinet which for example can be separated from the washing volume 13 by means of a partition wall or the like. The dishwasher is also provided with some kind of spray nozzles or rotatable spray arms formed with spray nozzles in the inside bottom of the body. This spray system is not illustrated in the drawings, for the sake of simplicity, but may be of an ordinary kind known in the art.

Figure 4:
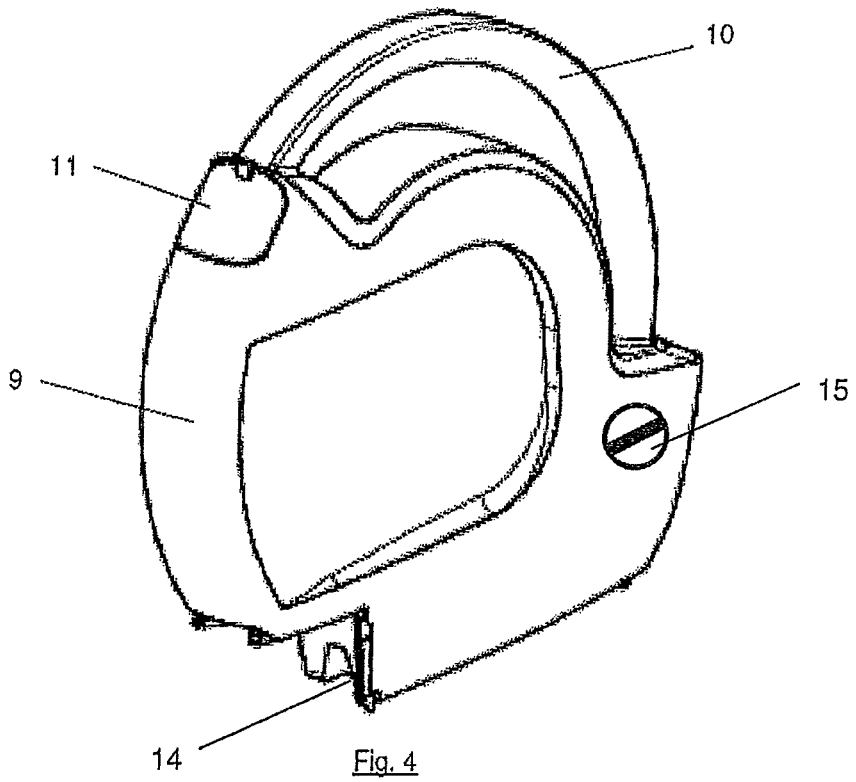
FIG. 4 is a perspective view of the removed water tank.

The water tank 9 is detachable from the dishwasher, as is illustrated in FIG. 3, where the interior of the dishwasher is shown with the tank removed, and in FIG. 4, where the water tank 9 is shown detached from the dishwasher. The water tank has an essentially flat and circular outer appearance and comprises a handle 10 to facilitate gripping and carrying it. In an upper portion, the water tank is formed with a filler hole having an openable lid 11, to allow filling of water from e.g. a water tap, and in a lower portion it is provided with a not in detail shown quick coupling 14 to allow readily connection to a water pump 12 inside the dishwasher. In addition to the filler hole at the openable lid 11, the water tank is provided with a supplementary filler hole having an openable lid 15 in one of its lateral surfaces. This supplementary filler hole has the purpose of facilitate filling of water where the space is limited, such as for example under a tight positioned water tap. The water pump is connected to the spray nozzles, to allow spraying of water towards the dishes. The draining of the water, on the other hand, is intended to be carried out by means of gravity through the drain hose by opening of an electrically operated valve to the drain hose. Inside is also provided a not shown heater for allowing heating of the water to a desired temperature.

The dishwasher comprises a dish rack (7) located within the cabinet for positioning of dishes to be cleaned, a spray nozzle system adapted to spray washing liquid over the dishes during washing, a heater for heating of the water, a drain hose (6) which in one end is connected to the dishwasher and having a free outer end to be positioned in a waste water discharge, at least one pump (12) connected to the spray nozzle system for pumping washing liquid to the spray nozzle system during washing, and a mains supply cable to be connected to a mains supply for operation of the dishwasher. The dishwasher also has a user interface (22) located at the front of the cabinet. The user interface comprises control bottoms and a display.

The waste water is drained from the dishwasher through the drain hose (6) by means of gravity, wherein the draining through the drain hose is controlled by means of an electrically operated valve.

To facilitate the moving of the dishwasher, when moving to another apartment or just freeing bench top space for cooking, the dishwasher has handles, preferably located at the sides of the cabinet, for lifting and carrying the dishwasher.

Figure 5:
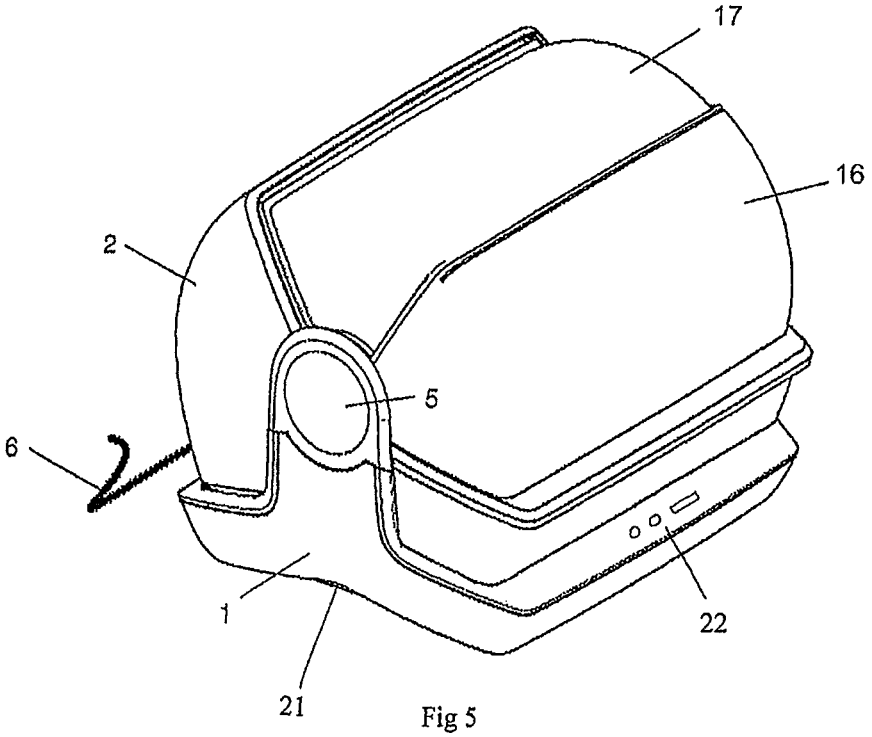
FIG. 5 is a perspective view of a dishwasher according to the invention with the door in a closed state.

In FIG. 5 dishwasher with the same components as in FIG. 1 except that it comprises two door portions is disclosed. The two door portions 16 and 17, which each is formed with a part circular shape in cross section and are rotatably arranged in relation to a hinge joint 5 at each side of the dishwasher, e.g. a roll front door. The hinge joints 5 define a common rotary axis for the door portions 16, 17 and the rotary axis also represents a common axis of curvature for the part circular door portions. Such an arrangement of the door portions allows them to be opened and closed by sliding in relation to each other and the cabinet of the dishwasher, such that the lid portion 17 is displaced to a position within the rear cover portion 2 and the lid portion 16 is displaced between the lid portion 17 and the rear cover portion 2.

The invention claimed is:

1. A dishwasher comprising a cabinet, having an opening at the front of the cabinet, allowing access to a washing chamber defining a volume inside of the cabinet configured to receive dishes to be washed, a door adapted to close the opening, a water tank configured to be removably positioned inside the volume of the washing chamber, and a coupling element configured to detachably engage the water tank with the dishwasher within the volume of the washing chamber, such that engagement of the coupling element fluidly connects the water tank and the dishwasher, wherein the water tank is configured to be filled with water for washing, wherein the opening is adapted in size to receive the water tank therethrough for being positioned inside the washing chamber, wherein the water tank is detachable, wherein the coupling element is configured to detachably engage the water tank with a spray nozzle system of the dishwasher adapted to spray washing liquid over the dishes during washing, and wherein the coupling element is configured to form a watertight connection between the water tank and the spray nozzle system, such that the water tank is configured to supply water to the volume of the washing chamber via the spray nozzle system.

2. A dishwasher according to claim 1, wherein the opening comprises a main vertical frontal opening part and a horizontal top opening part.

3. A dishwasher according to claim 1, wherein the cabinet can hold at least the same amount of water as can be accommodated inside the water tank.

4. A dishwasher according to claim 1, wherein the door is a slidable door.

5. A dishwasher according to claim 4, wherein the door has a part circular shape in cross section, and is composed of one or more portions.

6. A dishwasher according to claim 4, wherein a dish rack is positioned inside the cabinet, said dish rack comprises means for preventing dishes to block the opening of the door.

7. A dishwasher according to claim 1, wherein the dishwasher comprises handles located at the sides of the cabinet, for lifting and carrying the dishwasher.

8. A dishwasher according claim 1, wherein the dishwasher also comprises a dish rack located within the cabinet for positioning of dishes to be cleaned, a heater for heating of the water, a drain hose which in one end is connected to the dishwasher and having a free outer end to be positioned in a waste water discharge, at least one pump connected to the spray nozzle system for pumping washing liquid to the spray nozzle system during washing, and a mains supply cable to be connected to a mains supply for operation of the dishwasher, and a user interface located at the front.

9. A dishwasher according to claim 8, wherein waste water is drained from the dishwasher through the drain hose by means of gravity, wherein the draining through the drain hose is controlled by means of an electrically operated valve.

10. A water tank for a dishwasher according to claim 1, wherein the water tank comprises a gripping portion comprising a handle or grooves suitable for gripping.

11. A water tank according to claim 10, wherein the water tank comprises connection means in the bottom part for connection to the dishwasher.

12. A water tank according to claim 10, wherein the water tank comprises a first filler hole in an upper portion and an additional filler hole in a lateral surface.

13. A water tank according to claim 10, wherein the water tank contains a volume of water of maximum 6 liters.

14. A water tank according to claim 10, wherein the water tank contains a volume of water of maximum 5 liters.

15. A water tank according to claim 10, wherein the water tank contains a volume of water of maximum 4 liters.

16. A dishwasher according to claim 1, wherein the water tank defines a volume of water configured to supply an entire washing cycle.

17. A dishwasher according to claim 1, wherein the coupling element is further configured to detachably engage the water tank with at least one pump, such that the water tank is configured to form a watertight connection with the at least one pump.

18. A dishwasher according to claim 17, wherein the at least one pump is fluidly connected with the spray nozzle system of the dishwasher, such that the at least one pump is configured to pump water from the water tank to the spray nozzle system.

* * * * *